US005477590A

United States Patent [19]

Grabher

[11] Patent Number: 5,477,590

[45] Date of Patent: Dec. 26, 1995

[54] SINGLE ARTICULATION DOOR HINGE

[75] Inventor: Guenter Grabher, Fussach, Austria

[73] Assignee: Grass AG, Hochst/Vlbg., Austria

[21] Appl. No.: 243,954

[22] Filed: May 17, 1994

[51] Int. Cl.[6] ..... E05F 3/20; E05D 7/00

[52] U.S. Cl. ..... 16/297; 16/305; 16/325

[58] Field of Search ..... 16/255, 278, 305, 16/321, 325, 341, 343, 286

[56] References Cited

U.S. PATENT DOCUMENTS 2,538,372 1/1951 Light ..... 16/305

5,027,474 7/1991 Bowers ..... 16/341

5,392,493 2/1995 Youngdale ..... 16/321

*Primary Examiner*—Mark Rosenbaum

*Assistant Examiner*—Kenneth J. Hansen

*Attorney, Agent, or Firm*—Petree Stockton

[57] ABSTRACT

Single articulation door hinge with pressure locking device on a hinge arm, which is located in a hinge cup on a hinge axis; whereby, leg springs of the hinge arm are held resiliently in connection with a pressure roller; whereby, the leg springs are supported with two contact surfaces on the cup casing and have a contact point on the hinge axis.

5 Claims, 4 Drawing Sheets

SINGLE ARTICULATION DOOR HINGE

BACKGROUND OF THE INVENTION

1. Field of the Invention

The present invention relates to door hinges and more particularly to a single articulation door hinge having a spring urging resilient pressure on a cam of the hinge arm.

DESCRIPTION OF THE PRIOR ART

Similar door hinges were made known with U.S. Pat. No. 5,421,063 (Continuation of abandoned application Ser. No. 07/755,665). With these hinge types, the leg spring either loops around the hinge axis or is held in its own receptacle.

The disadvantage of these types of hinges is that in order to loop the hinge axis, the axis must undergo a separate operation in order to prepare a fitting receptacle for the leg spring.

In other cases, the fastening of the spring to additional receptacles likewise results in higher manufacturing costs.

Both these types of hinges also have in common that the assembly of the spring leg to the door hinge is difficult to achieve.

Therefore, the task of the submitted invention is to further develop the single articulation hinge previously mentioned, so that a simple and cost effective production and assembly of the door hinge guarantees the retention of the contact pressure operation of the spring leg on the hinge arm.

SUMMARY OF THE INVENTION

The present invention provides a hinge having a hinge cup with a cup casing and hinge axis, a hinge arm provided with a cam and pivoted on the hinge axis, and a spring supported in the cup casing and urging a resilient spring pressure on the hinge arm cam.

It significant and fundamental that the spring leg of the present invention has two contact surfaces on the cup casing and a contact point on the hinge axis.

The spring leg is therewith simply clamped between the hinge axis and the cup casing; there is no longer a need for special grooves on the hinge axis or separate receptacles for the free spring ends.

Thus, a significant and fundamental advantage is achieved; the spring can be inserted in the assembly by simply sliding in from the side. Thereby, for example, the spring can be inserted by sliding in with of the placed pins in the inner space of the spring coil. This pin can remain until the final assembly of the spring and no longer must, as previously required, be pulled back, as soon as the spring leg is brought on the hinge axis.

It is provided in a further development of the invention, that the free end of the spring leg is supported by a contact surface of the cup casing while the coil of the spring leg supported by the cup casing as well as the hinge arm.

The two free spring ends take over the desired press contact operation.

A first embodiment provides that a free spring end operates directly on a cam on the hinge arm so that no additional elements must be interposed.

Another embodiment provides that the spring end bends down and a pin inserts in the resulting receptacle. The free spring end is no longer pressed on the cam of the hinge arm, but instead the pin is pressed on the cam of the hinge arm.

This pin can also be provided with a roller or bushing in order to prevent the resulting frictional force by the opening and closing of the hinge.

The basis of the submitted invention results from not only the matter of the individual patent claims, but also the various combinations of the individual patent claims. All records, documents and evidence, inclusive of the summary, open and disclosed statements and declarations, especially those represented embodiments in the drawings, will be claimed as fundamental and significant inventions, as far as the claims individually or in combinations are relative to the position that the technology is new.

BRIEF DESCRIPTION OF THE DRAWINGS

The invention at hand will be explained more precisely by the various embodiments shown by representational drawings. Hereby, additional significant and fundamental features and advantages of the invention will be concluded from the designs and their descriptions.

Thereby indicated.

DESCRIPTION OF THE PREFERRED EMBODIMENT

Figure 1:
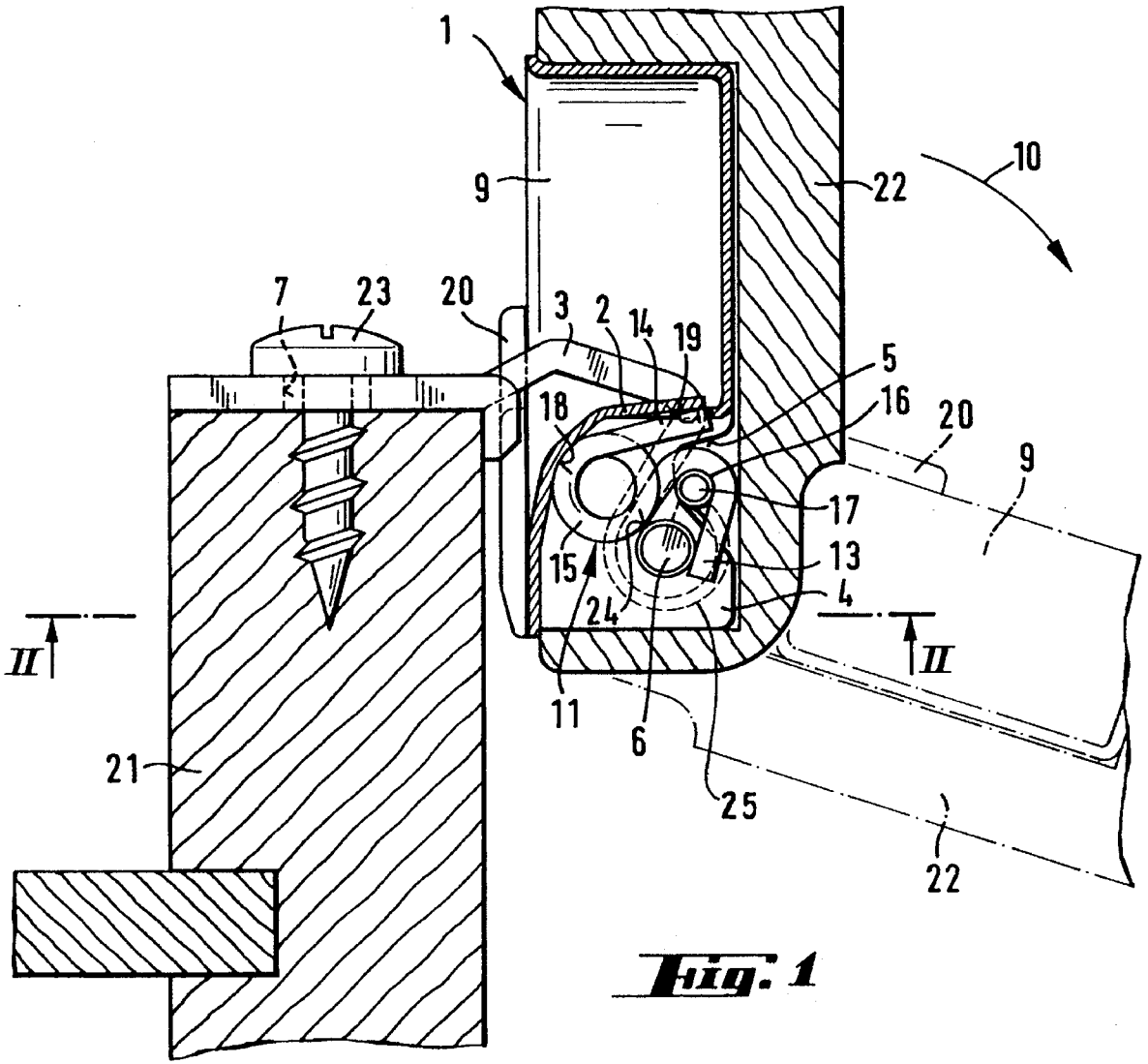
FIG. 1 a cross section through the single articulation door hinge of the present invention along the Line I—I in FIG. 2.
Figure 2:
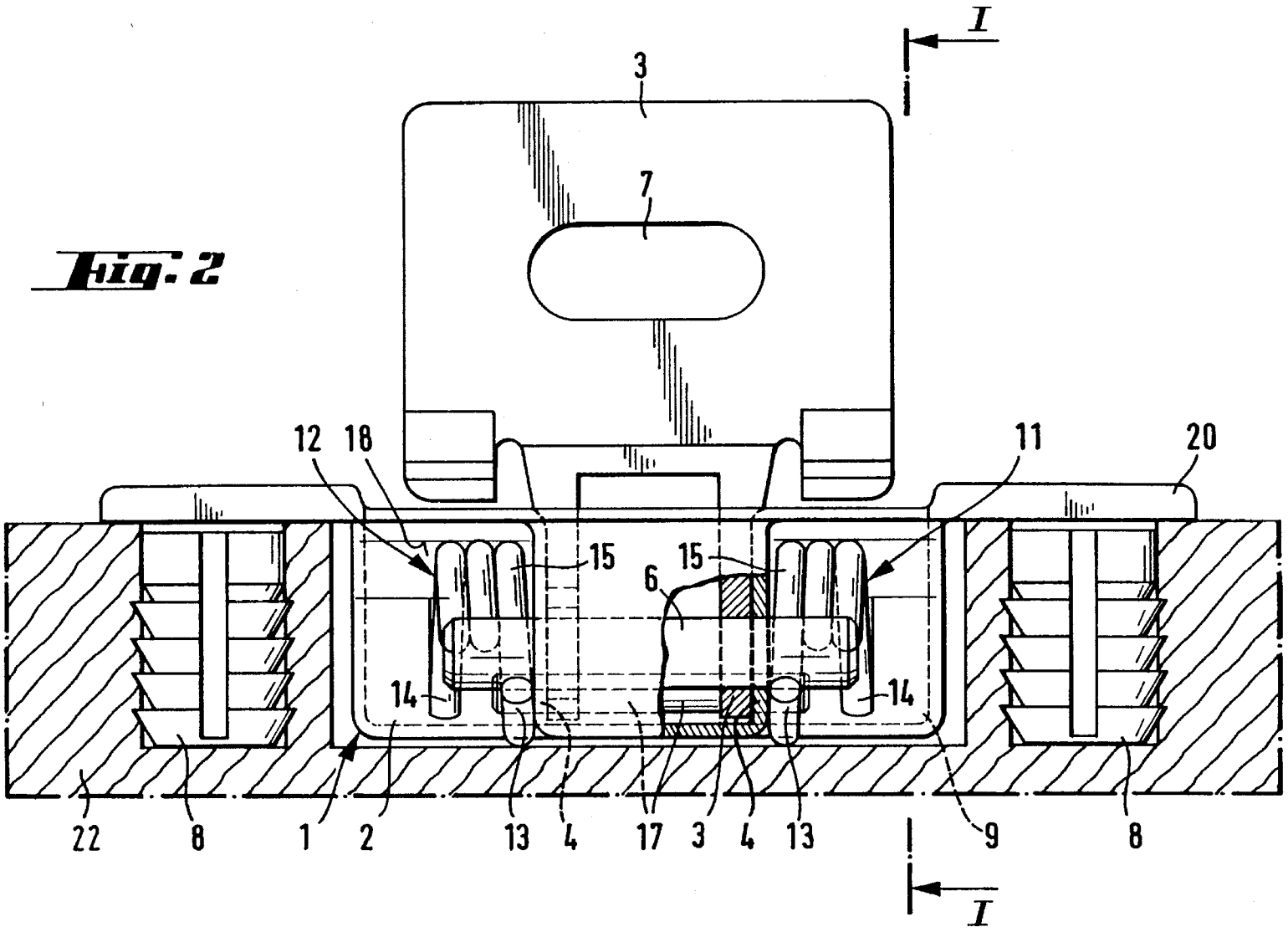
FIG. 2 a cross section through the single articulation door hinge along the Line II—II in FIG. 1.
Figure 3:
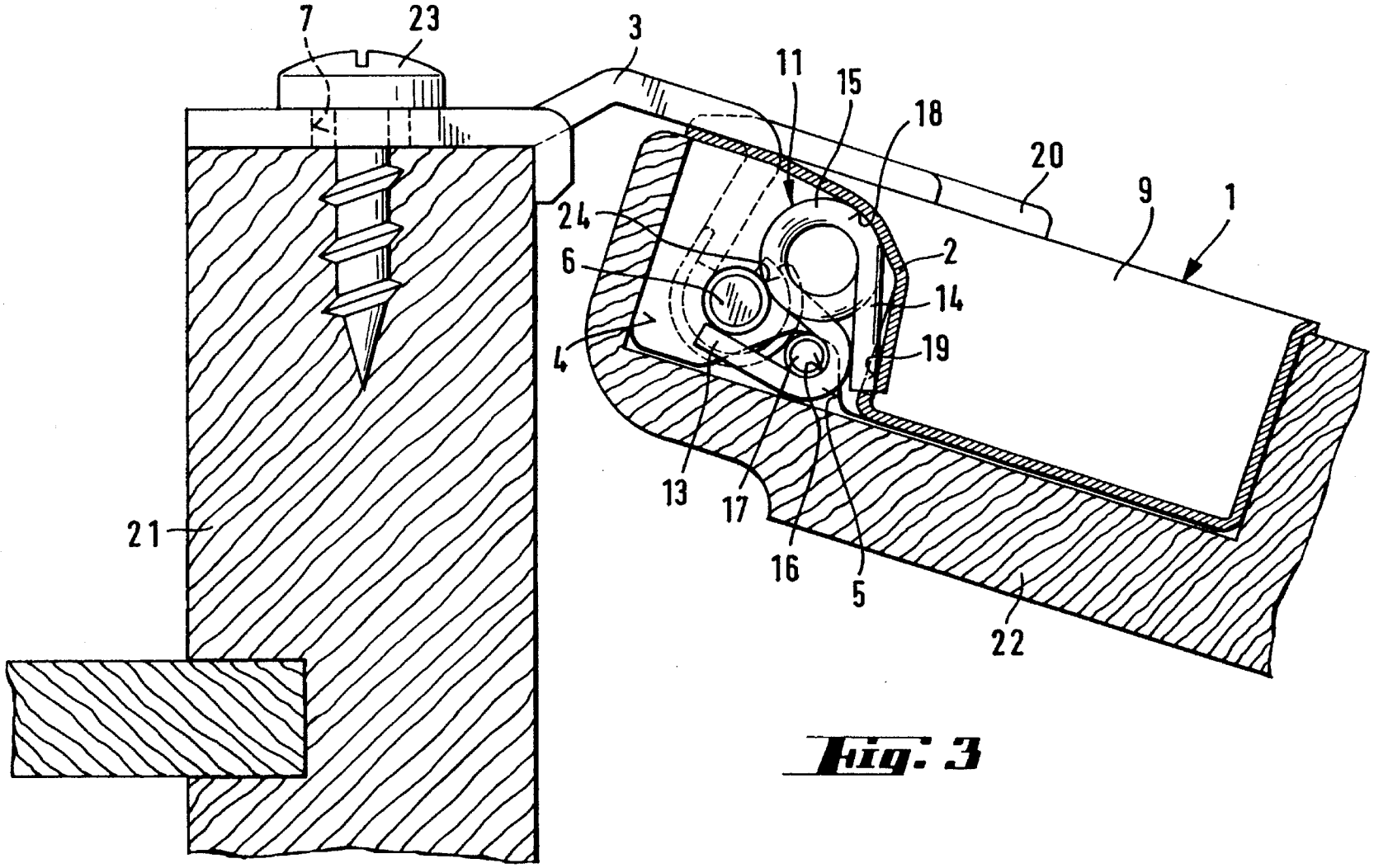
FIGS. 3 and 4: cross sections through the single articulation door hinge shown in FIG. 1 in position indicated by arrow direction 10 in FIG 1.
Figure 4:
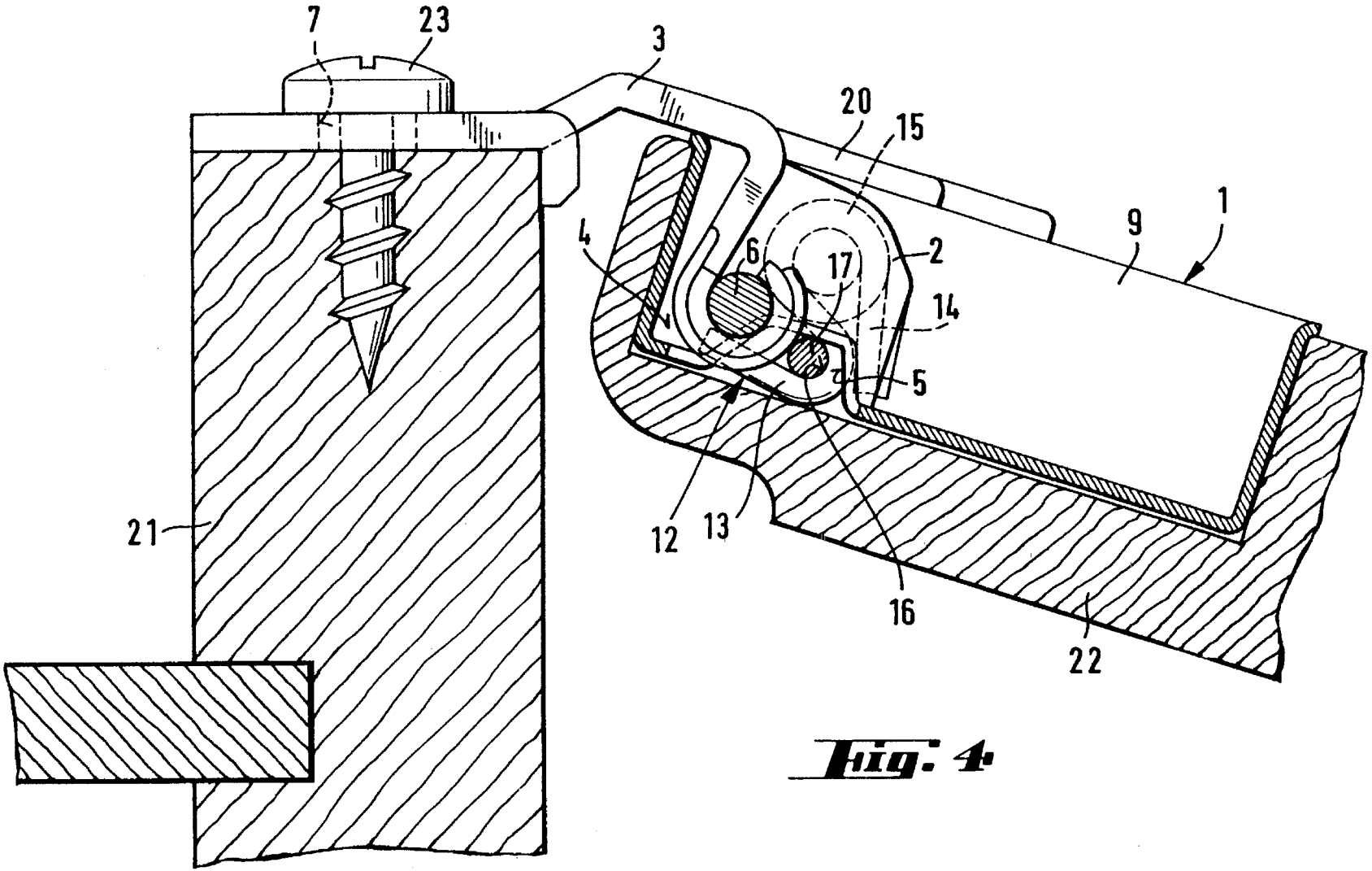

According to FIGS. 1 and 2, the single articulation door hinge consists in a known manner of a hinge cup (1) which has a cup casing (2). A hinge arm (3) is located rotatable on the cup casing (2).

The cup casing (2) has two inner walls (4) in which the hinge axis (6) is located. A hinge arm (3) is located rotatable on the hinge axis (6), so that in total a turning motion is possible between the hinge arm (3) and the cup casing (2).

Here in the represented embodiment example the inner wall (4) has on its underside a recess (5), which is required for the insertion and fixing of the pin (17).

The fastening of the hinge arm on a wall (21) follows by means of one or more screws (23), which engages a lengthwise notch (7) in the hinge arm (3); whereby, an adjustment of the hinge arm is possible in relation to the wall (21).

The hinge cup (1) with the cup casing (2) is fastened over one or more fasteners (8) in a corresponding notch of the door (22).

Thereby, the hinge cup (1) with its border (20) is supported by the surface of the door (22) and thus guarantees a secure fit.

Two spring legs (11, 12) serve to press the pin (17) on a cam on the hinge arm (3) as shown in FIG. 1. These spring legs (11, 12) have one or more coils, which run out in the spring ends (13, 14). Thereby, on the one hand, the coils (15) are supported by the corresponding contact surfaces (18) of the cup casing and on the other hand on the contact point (24) on the hinge axis (6).

One spring end (14) is supported likewise on a corresponding contact surface (19) of the cup casing (2), while the other spring end (13) is bent to form a receptacle (16) for the pin (17).

The pin (17) engages back through the recess (5) of the inner walls (4) and fits with its outer side on a cam of the hinge arm (3) as shown in FIG. 1.

As shown in FIG. 1, the hinge cup (1) swings with the accompanying attachment components in arrow direction (10); and, in a pressure roller arrangement between pin (17) and cam (25) of hinge arm (3), (17) slides along on and is pressed against the cam (25) of the hinge arm (3) and.

The hinge arm (3), as well as the head of the screw (23) is taken up in a closed position within the inner space (9) of the hinge cup (1).

Opening and closing the hinge can result in shifting of the spring legs (11,12) in relation to the cup casing (1) and the hinge axis (6). However, the contact surfaces (18, 19) on the cup casing, are so formed that this shifting has no negative consequences.

With the door hinge of the present invention, it is possible for the first time to have a simple and cost effective production, and assembly is achieved with the retention of the contact press function.

I claim:

1. A single articulation hinge for supporting a door on a frame, one of the door and frame having portions defining a bore hole, the hinge comprising: a hinge cup fastenable in said bore hole of one of said door and frame and having a cup casing and a hinge axis, the cup casing having portions defining at least two contact surfaces and the hinge axis having portions defining at least one contact point; a hinge arm pivoted on the hinge axis and fastenable to the other of said door and frame, the hinge arm including pressure roller means; a spring supported at least in part on said at least two cup casing contact surfaces and at least in part on said at least one hinge axis contact point and urging a resilient spring force on said hinge arm pressure roller means; and said spring having at least one closed coil with a bent end and a free end, and the spring is supported at least in part by the spring free end on one of said at least two cup casing contact surfaces.

2. The single articulation hinge according to claim 1, wherein said spring is supported at least in part by said closed coil on the other of said at least two cup casing contact surfaces and at least in part by the closed coil on said at least one hinge axis contact point.

3. The single articulation hinge according to claim 2, said hinge arm pressure roller means comprising a cam disposed on the hinge arm, and said spring is supported at least in part by the hinge arm cam.

4. The single articulation hinge according to claim 3, further comprising a pair of said springs, said bent end of each spring defining a pin receptacle, and said hinge arm pressure roller means further comprising a pin received in the receptacles and urged by the springs against said hinge arm cam.

5. The single articulation hinge according to claim 4, wherein said pin is provided with a bushing and is rollable on said hinge arm cam surface.

* * * * *